US006583706B2

(12) United States Patent
Larikka

(10) Patent No.: US 6,583,706 B2
(45) Date of Patent: Jun. 24, 2003

(54) TOROIDAL CHOKING COIL

(75) Inventor: Longinos Larikka, Sundom (FI)

(73) Assignee: Vacon Oyj, Vaasa (FI)

( * ) Notice: Subject to any disclaimer, the term of this patent is extended or adjusted under 35 U.S.C. 154(b) by 0 days.

(21) Appl. No.: 09/796,697

(22) Filed: Mar. 2, 2001

(65) Prior Publication Data

US 2001/0020887 A1 Sep. 13, 2001

(30) Foreign Application Priority Data

Mar. 13, 2000 (FI) ..... 20000573

(51) Int. Cl.[7] ..... H01F 27/28
(52) U.S. Cl. ..... 336/229; 336/210
(58) Field of Search ..... 336/229, 209, 336/210, 211, 213

(56) References Cited

U.S. PATENT DOCUMENTS

| | | | | |
|---|---|---|---|---|
| 1,784,833 A | | 12/1930 | Hagemann et al. | |
| 3,812,554 A | | 5/1974 | Klappert | |
| 4,728,919 A | | 3/1988 | Dirmeyer | |
| 4,789,849 A | * | 12/1988 | Ballard et al. | 336/210 |

FOREIGN PATENT DOCUMENTS

| | | |
|---|---|---|
| DE | 36 13 862 A1 | 10/1987 |
| EP | 0 226 793 A1 | 7/1987 |
| FI | 864780 | 5/1987 |
| JP | 59-148314 | 8/1984 |
| JP | A 7-45444 | 2/1995 |
| JP | A 11-176649 | 7/1999 |

* cited by examiner

*Primary Examiner*—Elvin Enad
*Assistant Examiner*—Tuyen T. Nguyen
(74) *Attorney, Agent, or Firm*—Oliff & Berridge, PLC

(57) ABSTRACT

The invention relates to a toroidal choking coil comprising a substantially annular core, a winding around the core, and a fixing device arranged around the core substantially between the core and the winding. The toroidal choking coil is characterized in that the fixing device comprises a hoop-like collar and one or more fasteners resting on the collar for attaching the toroidal choking coil onto fastening surfaces of a mounting site. The collar and the fasteners resting on the collar are manufactured from one piece. An inner rim that fastens against the core of the collar comprises several adjacent wavefronts that are transversely located with respect to an outer surface of the core and that comprise successive valleys and protrusions.

9 Claims, 5 Drawing Sheets

TOROIDAL CHOKING COIL

FIELD OF THE INVENTION

The invention relates to a toroidal choking coil comprising a fixing device to enable the toroidal choking coil to be attached to electric appliances or the like. The fixing device comprises a hoop-like collar, fasteners resting on the collar for attaching the choking coil onto fastening surfaces of the appliances or the like.

The invention also relates to a method for manufacturing such a toroidal choking coil.

BACKGROUND OF THE INVENTION

A toroidal choking coil is an electric, technical component wound around an annular core that usually comprises one or more adjacent iron rings; more precisely, it is a coil used for filtering interference that occurs in electric current. A fixing device of the toroidal choking coil refers to a device that enables the toroidal choking coil to be attached to an electric appliance or the like.

According to a known solution, a pre-wound toroidal choking coil is cast in cast resin, the mold used in the casting being provided with fasteners that enable the toroidal choking coil to be attached to an appliance.

However, this solution is problematic in various ways. Firstly, several different molds are needed to carry out castings of different sizes and shapes, which is expensive and impractical. Secondly, such a cast piece takes a lot of space and is relatively heavy. The cast resin forms a closed structure around the choking coil, decreasing heat evaporation, which results in reduced cooling of the choking coil. The specific heat coefficients of cast resin and the iron rings used in the core of the choking coil as well as the electric conductors differ from each other, which means that different thermal expansion of the different parts of such a closed component incurs a risk that the component might be damaged.

Another known solution is to suspend the toroidal choking coil on the fastening surfaces of the appliance using different types of straplike suspenders. The problem is then the poor reliability of the attachment and the risk that the choking coil might easily start to move, whereby the choking coil is more susceptible to damage; the risk that the moving choking coil might damage other components increases as well.

BRIEF DESCRIPTION OF THE INVENTION

An object of the invention is thus to provide a toroidal choking coil so as to enable the aforementioned problems to be alleviated.

This is achieved by a toroidal choking coil of the invention characterized by what is disclosed in the claims. To be more precise, the toroidal choking coil of the invention is mainly characterized by what is disclosed in the characterizing part of claim 1.

The invention further relates to a method for manufacturing a toroidal choking coil. The manufacturing method of the invention for manufacturing a toroidal choking coil is mainly characterized by what is disclosed in the characterizing part of claim 11.

The idea underlying the invention is that a fixing device, i.e. a fixing collar, is arranged on the outer surface of the annular core of the toroidal choking coil, i.e. between the core and the winding, the fixing device comprising fastening elements to enable the choking coil to be attached to the appliance or the like. The collar and the fastening elements arranged therein are preferably manufactured from a strip- or sheetlike material, such as a metal band or sheet. The fixing device then requires very little space, not increasing the size of the coil, and the fixing device also allows the coil to be entirely wound. In addition, the locations of the fasteners enabling the collar to be attached to the fastening surfaces of the appliance can be chosen freely, preferably with respect to the location of the coil. A preferred shaping enables the entire fixing device to be manufactured from one piece by bending it appropriately.

Furthermore, the collar is preferably narrower than the core, which means that the outer edges of the collar remain substantially inside the outer edges of the core. The outer edges of the collar are then unable to damage the winding because of dimensional changes in the materials caused by thermal expansion.

The inner surface fastening against the outer rim of the iron rings that form the core of the fixing collar of the invention comprises several adjacent wavefronts transversely located with respect to the outer rim of the ring, consisting of successive valleys and protrusions. In addition, the protrusions on the contact surface that fastens against the iron ring of the fastening collar may comprise flexible tongues extending against the outer surface of the iron ring. The wavelike structure and resilient tongues or a combination thereof of the inner surface of the fixing collar enable the fixing collar to yield and stretch in the longitudinal direction, the changes in the dimensions caused by thermal expansion to be compensated for and an adequately strong attachment to be retained. Secondly, the flexibility of the fixing device and the resulting possibility of expanding the rim of the fixing device may also be utilized in the assembly while installing the fixing device in place around the iron rings, particularly when the ends of the fixing device are attached fixedly to each other e.g. by welding.

Furthermore, the flexible structure of the fixing device enables greater tolerances in the size of the iron rings that form the core. The flexible tongues extending against the outer rim of the ring in the protrusions of the inner surface fastening against the ring of the fixing collar improve the contact of the fixing collar with the surface of the ring if the diameter of the rings varies within the scope of the manufacturing tolerance. The tongues operate such that they yield inwards towards the center of the diameter of the collar when the diameter of the ring is shorter than a collar of medium length, while on the other hand, they yield outwards away from the center of the diameter of the collar when the diameter of the ring is longer than a collar of medium length, thus at most equalling the contact surface of the collar.

The ends of the fixing collar of the toroidal choking coil are immovably locked in place when the collar is tightened in place around the rings that form the core. This is carried out by attaching the ends to each other by preferably clawlike locking elements in the locking device. A conventional nut and bolt attachment may also be used. The ends of the fixing collar may be attached to each other also by welding.

At the locking device, the ends of the collar are arranged to partly overlap each other. After being tightened in place around the core, the fixing device of the toroidal choking coil thus remains tightly in place, and the flexible structure of the fixing collar enables the collar to yield owing to thermal expansion of the core.

The structure of the toroidal choking coil of the invention comprising a collar-like fixing member is light in comparison to a device cast in cast resin, the cooling of the toroidal choking coil operating efficiently as well. It is also cheaper.

BRIEF DESCRIPTION OF THE DRAWINGS

The invention will be further explained with reference to the accompanying drawings, in which.

DETAILED DESCRIPTION OF THE INVENTION

Referring to FIGS. 1 to 8, an example of a typical toroidal choking coil of the invention will be described.

Figure 1:
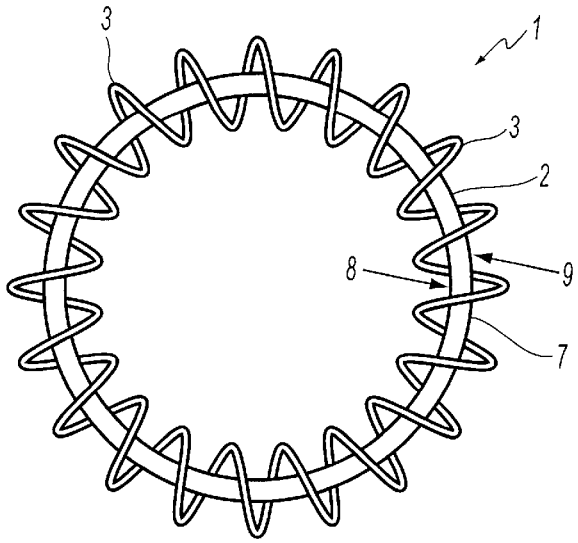
FIG. 1 PRIOR ART
FIG. 1 is a schematic view of a typical toroidal choking coil as seen in the crosswise direction thereof.
Figure 2:
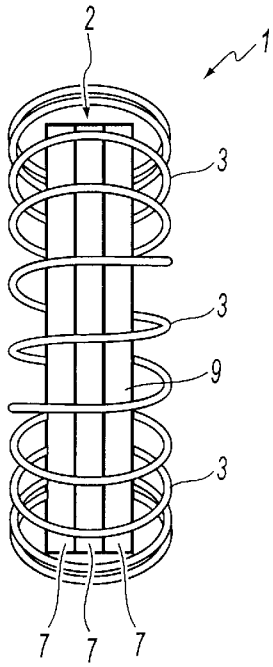
FIG. 2 PRIOR ART
FIG. 2 is a schematic view of the typical toroidal choking coil of FIG. 1 as seen in the longitudinal direction thereof.

According to FIGS. 1 and 2, a typical toroidal choking coil 1 generally comprises a core 2 and a winding 3 wound around the core 2. The core 2 is typically made of iron. The shape of the core 2 is typically annular, and the core comprises one or more rings 7 arranged parallelly side by side. The winding 3 is typically made of an insulated copper conductor and wound around the rim formed by a ring or rings. The annular core 2 thus comprises an inner rim 8 and an outer rim 9.

Figure 3:
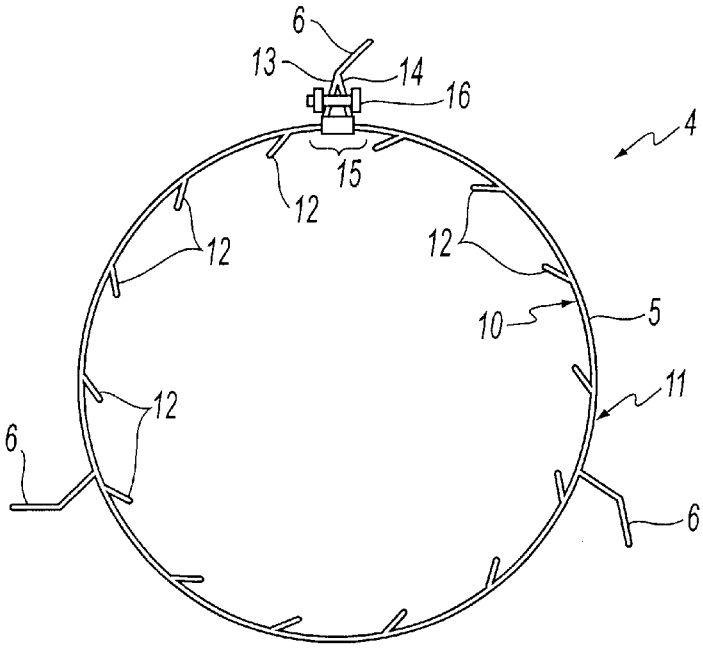
FIG. 3 shows an embodiment of a fixing device of the toroidal choking coil of the invention as seen in the crosswise direction thereof.
Figure 4:
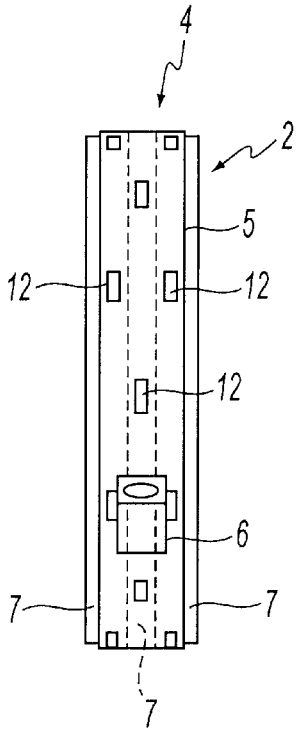
FIG. 4 shows the fixing device of the toroidal choking coil of FIG. 1 as seen in the longitudinal direction thereof.
Figure 5:
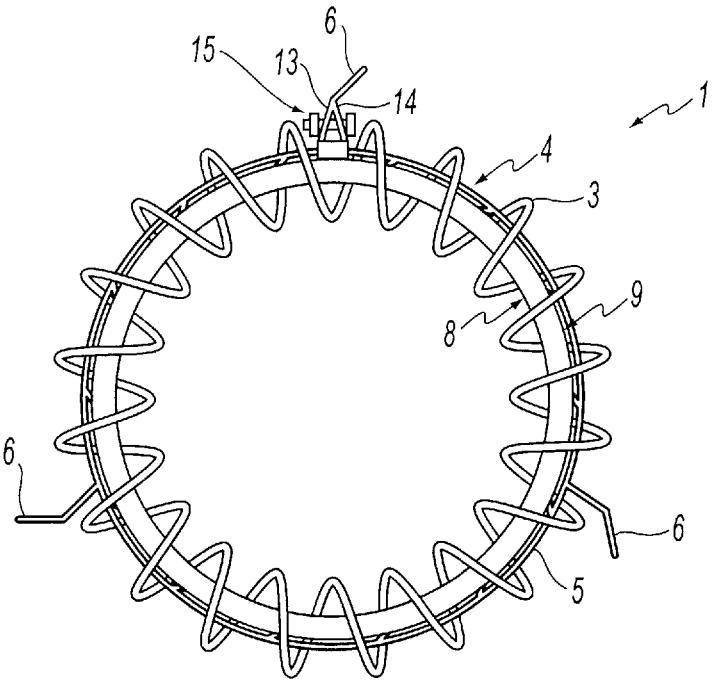
FIG. 5 shows the toroidal choking coil of the invention comprising a fixing device according to an embodiment of the invention as seen in the transverse direction of the toroidal choking coil.
Figure 6:
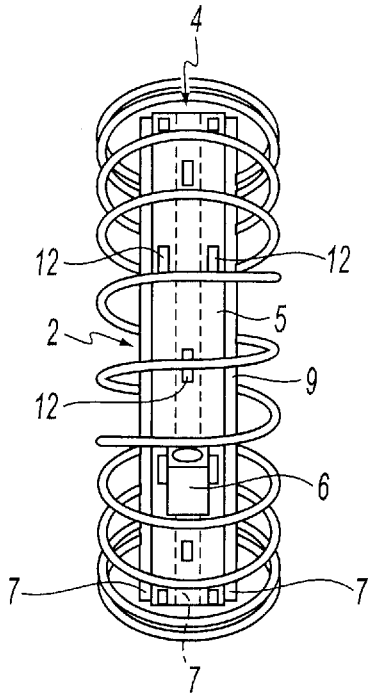
FIG. 6 shows the toroidal choking coil of FIG. 1 as seen in the longitudinal direction thereof.
Figure 7A:
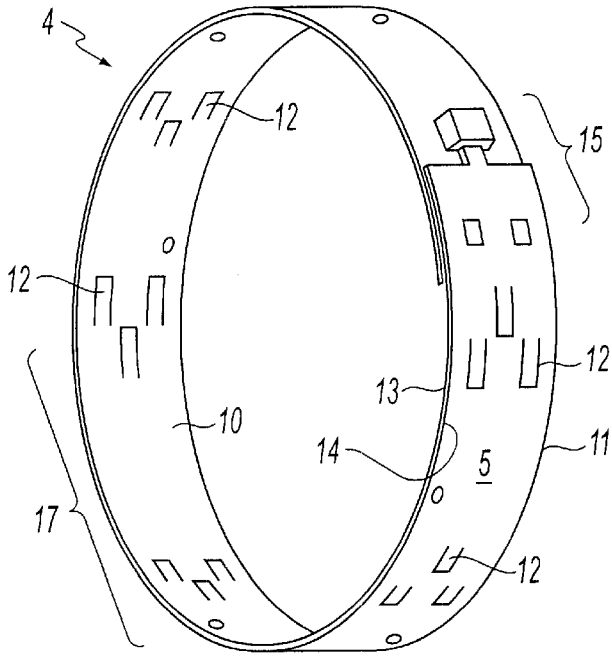
FIG. 7 is a schematic view of the fixing device and related structural details according to the invention of the fixing device.
Figure 7B:
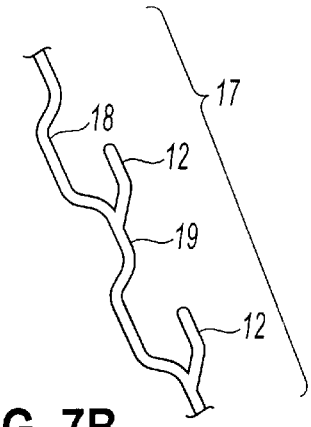
Figure 7C:
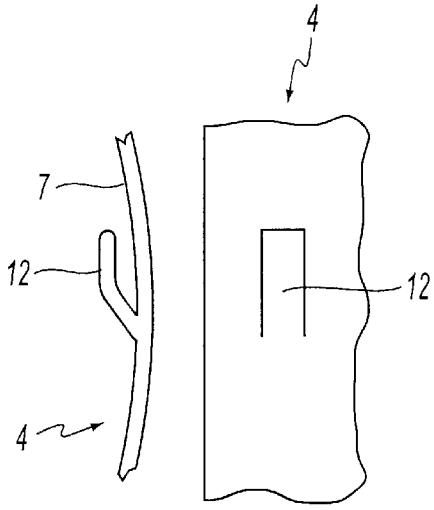

FIGS. 3 and 4 describe a fixing device 4 of the toroidal choking coil 1 according to a preferred embodiment of the invention. FIGS. 5 and 6 show a toroidal choking coil according to a preferred embodiment of the invention, comprising a fixing device 4.

According to FIGS. 5 and 6, the fixing device 4 is arranged on an outer surface 9 of the annular core 2 of the toroidal choking coil 1, i.e. between the core 2 and the winding 3. The structure of the fixing device 4 is a collar 5. The collar 5 comprises a rim with an inner surface 10 and an outer surface 11. The collar 5 is narrower than the core 2. The outer edges of the collar 5 thus remain substantially inside the outer edges of the core 2. The outer edge of the collar 5 may also be provided with a protective ring or band made e.g. of plastic or the like to protect the insulating surface of the conductor of the winding 3.

The rim of the collar 5 is an open structure, and the open section of the collar 5 is provided with locking elements 15, which are used for tightening and attaching the collar 5 immovably in place around the core 2. The locking elements 15 can be implemented in several different ways known to one skilled in the art. The embodiment of FIG. 3 describes a way to implement the locking elements 15. In accordance with the embodiment, the locking elements are arranged at ends 13 and 14 of the collar in the open section of the rim of the collar, the locking elements being ears 13 and 14. A hole is made through the ears 13 and 14 into which a fastening element 16 is arranged, the fastening element being a nut and bolt arrangement, screw or the like. When the fastening element 16 is a nut and bolt arrangement, by tightening this arrangement, the collar 5 can be tightened to a preferred tightness around the core 2.

Figure 8:
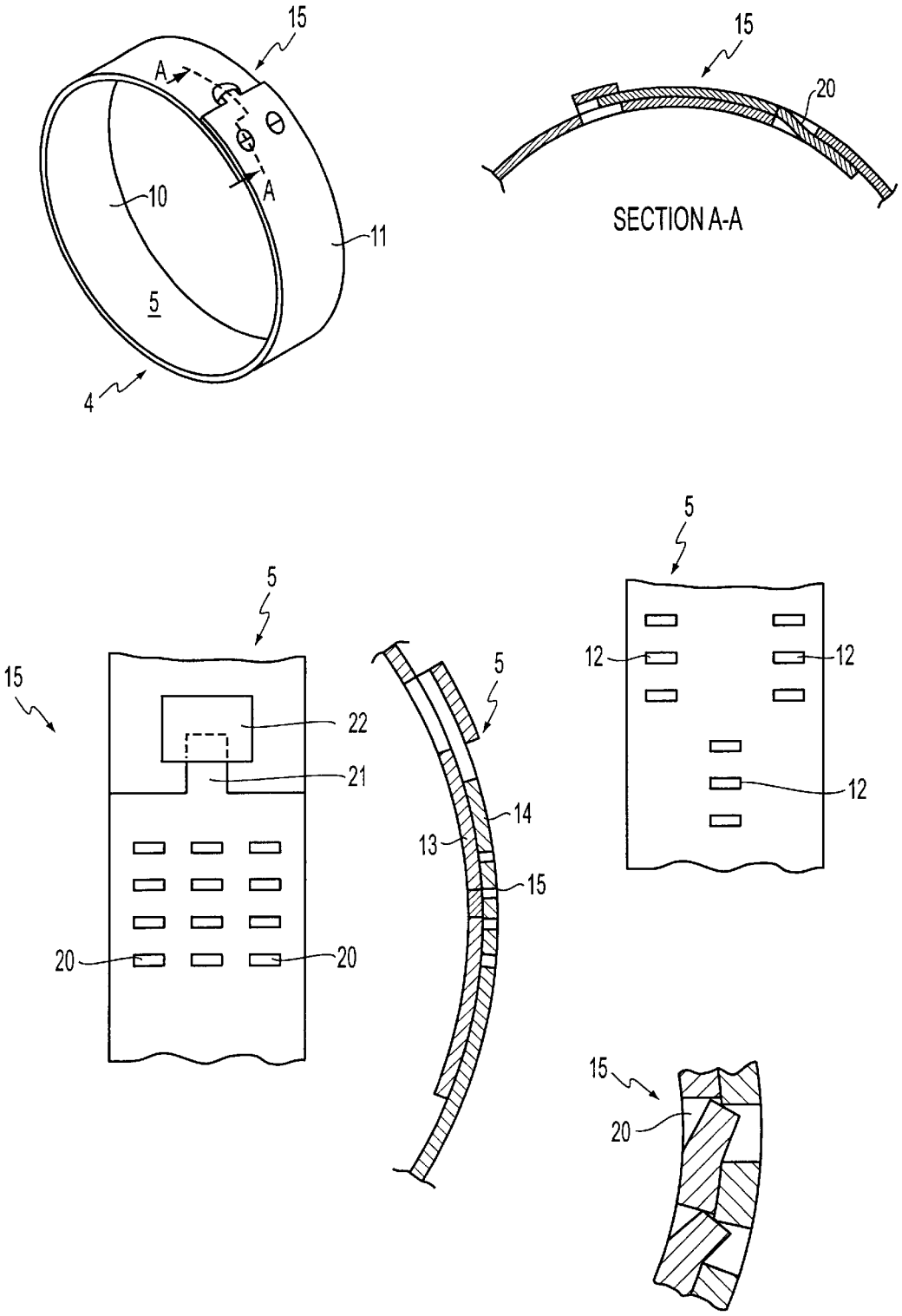
FIG. 8 is a schematic view of the fixing device and related structural details according to the invention of the fixing device.

Another preferred embodiment for implementing the locking device 15 is described in FIG. 8. In this embodiment, the ends 13 and 14 of the collar 5 are provided with clawlike locking elements 15, a tongue 21 and a lip 22. The clawlike locking elements 15 are provided at the ends 13 and 14 of the collar 5 that are arranged to overlap each other when being attached, whereby the locking claws 20 match against each other, locking the ends 13 and 14 of the collar 5 immovably in place. By arranging the tongue 21 under the lip 22, the ends 13 and 14 of the collar 5 are locked in place. The collar 5 is thus tightened to a preferred tightness around the core 2. The ends 13 and 14 of the collar 5 may also be welded together.

The fixing device 4 is provided with fasteners 6 to enable the toroidal choking coil 1 to be attached to an appliance or the like. In the preferred embodiment of FIGS. 3 and 5, the fasteners 6 are earlike and located on the outer surface 11 of the rim of the fixing device. The fasteners 6 point outwards from the center of the collar 5. The shape, locations on the rim of the fixing device 4 and number of fasteners 6 arranged in the fixing device 4 may vary depending on the place where the toroidal choking coil is attached to.

According to FIGS. 3 and 4, the contact surface, i.e. the inner surface 10, that fastens against the ring 7 of the collar 5 of the fixing device 4 comprises flexible tongues 12 extending against the outer surface 9 of the ring 7. The tongues 12 are located on the rim of the collar 5 and they are bent towards the center of the diameter of the collar 5. There may be one or more parallel tongues 12, the preferable number being the same as the number of rings 7 forming the core 2.

The flexible tongues 12 are produced by perforating the material of the fixing collar 5 at three edges and by bending the tongues 12 thus produced towards the center of the diameter of the collar 5. The unperforated edge of a tongue may be directed either in the crosswise, in the longitudinal or in any other direction of the collar. The tongues 12 operate such that they yield towards the center of the diameter of the collar 5 when the diameter of the ring 7 of the core 2 is shorter than a collar 5 of medium length. On the other hand, they yield outwards from the center of the diameter of the collar 5 when the diameter of the ring 7 is longer than that of medium length, thus equalling the inner surface 10 of the collar 5. The flexible tongues 12 on the inner surface 10 of the collar 5 enable the collar 5 to yield and thus the dimensional changes caused by thermal expansion to be compensated for and an adequately strong attachment to be retained.

The contact surface, i.e. the inner surface 10 of the rim of the collar 5, that fastens against the rings 7 forming the core 2 of the collar 5 of the fixing device 4 may, in addition to the tongues, comprise several adjacent wavefronts 17 transversely located with respect to the outer surface 9 of the rings 7 forming the core 2 and consisting of successive valleys 18 and protrusions 19. The wavelike structure 17 of the inner surface 10 of the collar 5 enables the collar 5 to yield and stretch in the longitudinal direction and thus the dimensional changes owing to thermal expansion to be compensated for and an adequately strong attachment to be retained.

The wavelike structure 17 of the inner surface 10 of the collar 5 and the flexible tongues 12 may also be arranged in the same collar 5. The tongues 12 are then preferably arranged at the protrusions 19 in the wavefront 17. Such a combination enables the collar 5 to yield and stretch in the longitudinal direction and thus the dimensional changes owing to thermal expansion to be compensated for and an adequately strong attachment to be retained. Secondly, the flexibility of the fixing collar 5 and the resulting possibility of expanding the rim of the fixing collar 5 can be utilized in the assembly while installing the fixing device in place around the iron rings 7, particularly when the ends of the fixing device are attached fixedly together e.g. by welding.

The flexible structure of the collar 5 enables greater tolerances in the size of the iron rings 7 forming the core 2. The tongues 12 and protrusions 19 on the contact surface, i.e. the inner surface 10, that fastens against the ring 7 of the collar 5 improve the contact of the collar 5 with the surface of the ring 7 if the diameter of the rings 7 varies within the scope of the manufacturing tolerance.

The collar 5 and the fasteners 6 arranged therein and the locking elements 15 may preferably be manufactured from a thin, strap- or sheetlike material, typically from a metal band or sheet. The fixing device 4 then requires very little space, not increasing the size of the toroidal choking coil 1, and the fixing device 4 also allows the toroidal choking coil 1 to be entirely wound.

The manufacturing material of the fixing device 4 is given the shape of the annular collar 5 characteristic of the fixing device 4 and it is provided with appropriate perforations. A preferred shaping enables the fixing device 4 in its entirety, all structural components included, to be manufactured from one piece by bending it appropriately. This is performed using methods known to one skilled in the art for handling strip- or sheetlike materials.

The manufacturing method of the invention for manufacturing a toroidal choking coil enables the toroidal choking coil 1 to be manufactured, into which the fixing device 4 of the invention of the toroidal choking coil 1 is integrated. The manufacture of the toroidal choking coil 1 begins by selecting, depending on the type of the choking coil, one or more annular, substantially iron elements 7 that form the core 2 of the choking coil 1, typically an iron ring. The selected rings 7 forming the core 2 of the choking coil 1 are arranged next to each other.

The fixing device 4 of the invention is arranged around the rings 7 that form the core 2, on the outer rim 9 of the rings. The fixing device 4 is tightened and locked in place. The winding 3 of the choking coil made from a suitable copper cable or the like is wound around the core 2 and the fixing device 4.

It is to be understood that the above description are the related drawings are only intended to illustrate the present invention. The invention is thus not restricted to the embodiment disclosed above or defined in the claims only but it will be obvious to one skilled in the art that the invention can be varied and modified in many ways within the scope of the inventive idea disclosed in the attached claims.

What is claimed is:

1. A toroidal choking coil comprising:

an annular core, a winding around the core, and a fixing device arranged around the core between the core and the winding, wherein the fixing device comprises a hoop-like collar and one or more fasteners resting on the collar for attaching the choking coil, the collar and the fasteners resting on the collar are manufactured from one piece, the collar comprises an inner rim and an outer rim, the inner rim of the collar that fastens against the core comprising several adjacent wavefronts, wherein said wavefronts consist of successive valleys and protrusions disposed transversely with respect to an outer surface of the core.

2. A toroidal choking coil as claimed in claim 1, wherein the annular core of the choking coil is manufactured from iron, and the core comprises one or more annular elements comprising an inner rim and an outer rim, the collar being arranged on the outer rim of the core of the toroidal choking coil, between the core and the winding.

3. A toroidal choking coil as claimed in claim 2, wherein the inner rim of the collar that fastens against the core comprising flexible tongues extending against the core, the tongues being obliquely bent towards the center of the diameter of the hoop-like collar.

4. A toroidal choking coil as claimed in claim 3, wherein the flexible tongues are arranged at the protrusion in the wavefront.

5. A toroidal choking coil as claimed in claim 1, wherein a locking device is arranged at ends of the collar for tightening the collar around the core and for attaching and locking the ends of the collar immovably to each other.

6. A toroidal choking coil as claimed in claim 5, wherein the locking device for attaching the ends of the collar to each other comprises clawlike locking elements.

7. A toroidal choking coil as claimed in claim 5, wherein the locking device for attaching the ends of the collar to each other comprises ears to be locked to each other by a fastening element.

8. A toroidal choking coil as claimed in claim 1, wherein the collar and the fasteners resting on the collar are manufactured from a strap- or sheetlike material.

9. A toroidal choking coil as claimed in claim 8, wherein the collar and the fasteners resting on the collar are manufactured from a metal band or a metal sheet.

* * * * *